United States Patent [19]

Bramkamp et al.

[11] Patent Number: 4,986,768

[45] Date of Patent: Jan. 22, 1991

[54] PLUG CONNECTOR FOR TELECOMMUNICATION AND DATA SYSTEMS

[75] Inventors: Wilhelm Bramkamp; Gunter Hegner, both of Berlin, Fed. Rep. of Germany

[73] Assignee: Krone AG, Berlin, Fed. Rep. of Germany

[21] Appl. No.: 444,762

[22] Filed: Dec. 1, 1989

[30] Foreign Application Priority Data

Dec. 2, 1988 [DE] Fed. Rep. of Germany ..... 3841083

[51] Int. Cl.[5] ..... H01R 13/64

[52] U.S. Cl. ..... 439/680; 439/709

[58] Field of Search ..... 439/677, 678, 679, 680, 439/681, 709, 712, 718, 723, 724, 620; 361/119

[56] References Cited

U.S. PATENT DOCUMENTS

| | | | |
|---|---|---|---|
| 4,795,375 | 1/1989 | Williams | 439/680 |
| 4,802,861 | 2/1989 | Gaston | 439/680 X |
| 4,871,330 | 10/1989 | Muller et al. | 439/709 |

FOREIGN PATENT DOCUMENTS

| | | | |
|---|---|---|---|
| 2262418C2 | 7/1974 | Fed. Rep. of Germany . | |
| 3015139 | 10/1981 | Fed. Rep. of Germany | 439/680 |
| 3027047C2 | 1/1983 | Fed. Rep. of Germany . | |
| 3525568A1 | 3/1987 | Fed. Rep. of Germany . | |

*Primary Examiner*—Neil Abrams
*Assistant Examiner*—Khiem Nguyen
*Attorney, Agent, or Firm*—McGlew and Tuttle

[57] ABSTRACT

A telecommunications plug connector arrangement, comprising a connector, including a connector housing and a connector tongue. The connector supported by the connector housing and joined to the connector housing at a lower edge of the connector housing. The connector tongue has contact tracks. A connector/disconnector bank provided with parallel rows of clamping contact slots, each clamping contact slot including a contact element. A center row of plug openings with contact springs for receiving an assigned tongue with contact tracks is provided, the connector/disconnector bank being symmetrical about a longitudinal central axis. A projection connected to one side of the connector housing is provided, the projection extending beyond said lower edge of the connector housing. A cover is provided engaging and covering one row of the clamping contact slots, so that in the event of misinsertion of the connector, the cover and the projection cooperate thereby preventing a connector tongue from being positioned incorrectly in a corresponding plug opening.

6 Claims, 3 Drawing Sheets

PLUG CONNECTOR FOR TELECOMMUNICATION AND DATA SYSTEMS

FIELD OF THE INVENTION

The invention relates to a plug connector for telecommunication and data systems.

BACKGROUND OF THE INVENTION

A plug connector of this kind is known in the art from FIG. 4 of German Patent Specification No. 35 25 568 A1. Herein, a connector engages by its connector tongue through a plug opening of the central row into the contact springs assigned to the plug opening. Cable wires are connected by pairs to the insulation displacement contacts assigned to the contact springs and arranged in the two outside rows of alterally extending clamping slots. With this arrangement contact tracks of the connector tongues must be assigned to specific cable wires of the cable wires connected by pairs. For this purpose, it is known in the art to provide the connector housing on its outside with an optical mark, in order to be capable to insert the connector always in the specific assignment to the cable wires connected by pairs.

However, the use of a connector housing with an optical mark requires that the user pay close attention when inserting the connectors into the bank. Faulty connections easily occur as the connectors can also be inserted reversed by 90° into the bank disposed symmetrically to the longitudinal center axis. Corresponding disadvantages apply for multi-pole connectors, too. The connectors being, here, of relevance, are damping, cross, short-circuit and cord connectors of connection or test cords.

SUMMARY AND OBJECT OF THE INVENTION

It is an object of the invention to provide a plug connector of the above mentioned type, for which it is guaranteed that the connectors can be inserted in one direction only into the plug openings and into the contact springs assigned thereto of the connector and disconnector bank disposed symmetrically to the longitudinal center axis, without the design of the bank body needing be modified.

The invention provides a telecommunications plug connector arrangement, comprising a connector, including a connector housing and a connector tongue. The connector tongue is supported by the connector housing and is joined to the connector housing at a lower edge of the connector housing. The connector tongue includes contact tracks. A connector/disconnector bank is provided having parallel rows of clamping/contact slots, each clamping/contact slot including a clamping/contact element. The bank also includes a center row of plug openings with contact springs for receiving an assigned tongue with contact tracks. The connector/disconnector bank is preferably symmetrical about a longitudinal central axis. The guaranteed orientation of the tongue with respect to the plug opening is a result of the provision of a projection connected to a side of the connector housing. The projection extends beyond the lower edge of the connector housing. A cover is provided engaging and covering one row of the clamping/contact slots, thereby preventing a connector tongue from being positioned incorrectly in a corresponding plug opening as an incorrect orientation would result in the projection striking the cover.

According to the invention, by the arrangement of at least one projection at the connector housing and the arrangement of one cover closing the one row of clamping slots of the bank body, it is ensured that the connector can only be inserted in one single direction into the bank. The plugging direction is given by the free row of clamping slots of the bank, over which the projection of the connector can engage when plugging the connector tongue correctly in. Reversing the connector by 180° is excluded, as then the projection of the connector would strike against the cover over the opposite clamping slot of the bank body, such that the projection of the connector cannot engage over the underlying row of clamping slots, as the cover enlarges the bank body sightly on one side. The projection according to the invention of the connector housing forms, in conjunction with the cover for the one row of clamping slots of the bank body, a positive-acting projection against being rotated, the protection offering substantial advantages over the uniquely known in the art optical protection against being rotated. This modification of known telecommunication connectors now allows, even with the smallest expenditure and only a few manual operations, the application of the plug connectors in data networks of data systems. For this purpose, e.g., the housing half shells known from DE 30 27 047 C2 are modified by a molded-on projection, such that the connector insertable, up to now, also in a position reversed by 180° into the bank body, is now safe against being rotated. Symmetry of the bank is removed by setting the cover on the one row of clamping slots of the bank body, said bank body being, in particular, known in the art from German Patent Specification No. 35 25 568 A1. The inventive arrangement provides the cover locks, herein, the covered row of clamping slots of the contacts assigned thereto. Removing the cover is possible only by destruction. It is possible, too, to snap-on a known, hinge-type label frame to be fixed to the bank body or a coding cap to be fixed to the bank as a cover and, thus, as an element of protection against being rotated for the plug connector according to the invention of the bank body. The invention is suitable for later-on mounting on existing connector and disconnector banks.

In the preferred embodiment, the width of the projection is identical to the width of a clamping slot. The projection engages on the one side into the clamping slot assigned to the plug opening for the connector tongue, if the connector is correctly plugged-in. With reversedly plugged-in connector, the projection will strike against the cover over the other row of clamping slots.

Still another object of the invention is to provide a telecommunications plug connector arrangement which provides a proper orientation of the connector tongue with respect to the plug opening and which arrangement is simple in design, rugged in construction and economical to manufacture.

While a specific embodiment of the invention has been shown and described in detail to illustrate the application of the principles of the invention, it will be understood that the invention may be embodied otherwise without departing from such principles.

DETAILED DESCRIPTION OF THE PREFERRED EMBODIMENT

Figure 1:
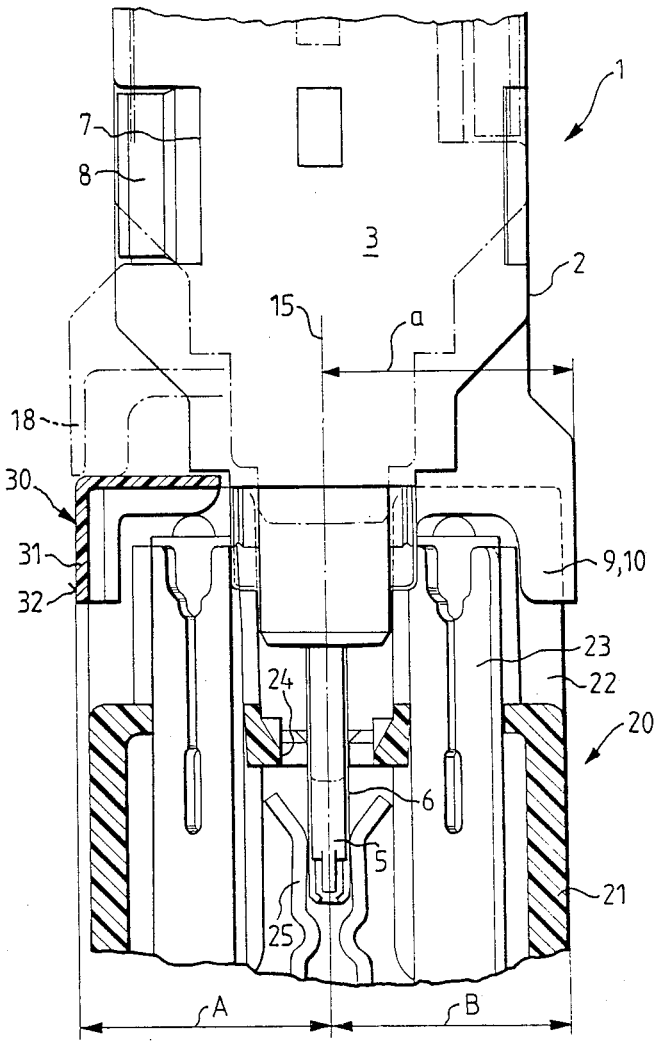
Fig. 1 is cross-sectional view of plug connector formed of a disconnector bank and of a disconnector plugged into the latter in an enlarged scale.

Referring to the drawings in particular, the invention embodied therein comprises a telecommunications plug connector arrangement including a connector 1 with a connector housing 2 and a connector tongue 5. The connector tongue is supported by and joined to the connector housing 2 at a lower edge of the connector housing 2. The connector tongue 5 includes contact tracks 6. A connector/disconnector bank 20 (see FIG. 2) includes parallel rows of clamping/contact slots 22 wherein in each clamping/contact slot is provided with a clamping/contact element 23. The connection/disconnector bank 20 includes a center row of plug openings 24 with contact springs 25 (see FIG. 1) for receiving an assigned tongue 5 with contact track 6. The connector/disconnector bank 20 is symmetrical about a longitudinal central axis. The proper orientation of the connector tongue 5 (a proper orientation of contact tracks 6) is guaranteed by the provision of a projection 9, 10 connected to a side 16 of the connector housing 2 (preferably a narrow side). The projection extends beyond a lower edge 11 of the connector housing 2. A cover 30 is provided engaging and covering one row of clamping/contact slots 22, thereby preventing a connector tongue 5 from being positioned incorrectly in a corresponding plug opening of 24.

The plug connector for telecommunication and data systems comprises a connector 1 and disconnector bank 20.

The disconnector bank 20 represented and described in detail in German Patent Specification No. 35 25 568 is symmetrical relative to the longitudinal center axis. The disconnector bank 20 comprises a bank body 21 made from a plastic material. In the upper side of the bank body 21, the two parallel rows of laterally extending clamping slots 22 having a pitch T and gaps W are formed. To each of the clamping slots 22 one insulation displacement contact 23 is assigned, which displacement contact 23 is disposed at an angle of 45° relative to the axis of the clamping slot 22.

The bank body further comprises the center row of plug openings 24, of which one plug opening 24 each is assigned to the two pairs of insulation displacement contacts 23. The insulation contacts 23, in turn, are assigned contact springs 25 disposed at the two lateral end sections of the elongated plug openings 24.

The plug 1 described in detail in German Patent Specification No. 30 27 047 C2 comprises a housing 2 of two substantially identical half shells 3, 4 including a connector tongue 5 therebetween. The connector tongue 5 is provided with four contact tracks 6, to which are assigned electrical components and connections, here not shown in detail, and disposed in the housing 2 of connector 1. The two half shells 3, 4 of the housing 2 are held together by latching hooks 8 engaging into openings 7. The half shells 3, 4 comprise at their lower side 11 latching projections 17 provided to engage into the clamping slots 22 of the disconnector bank 20.

Figure 4:
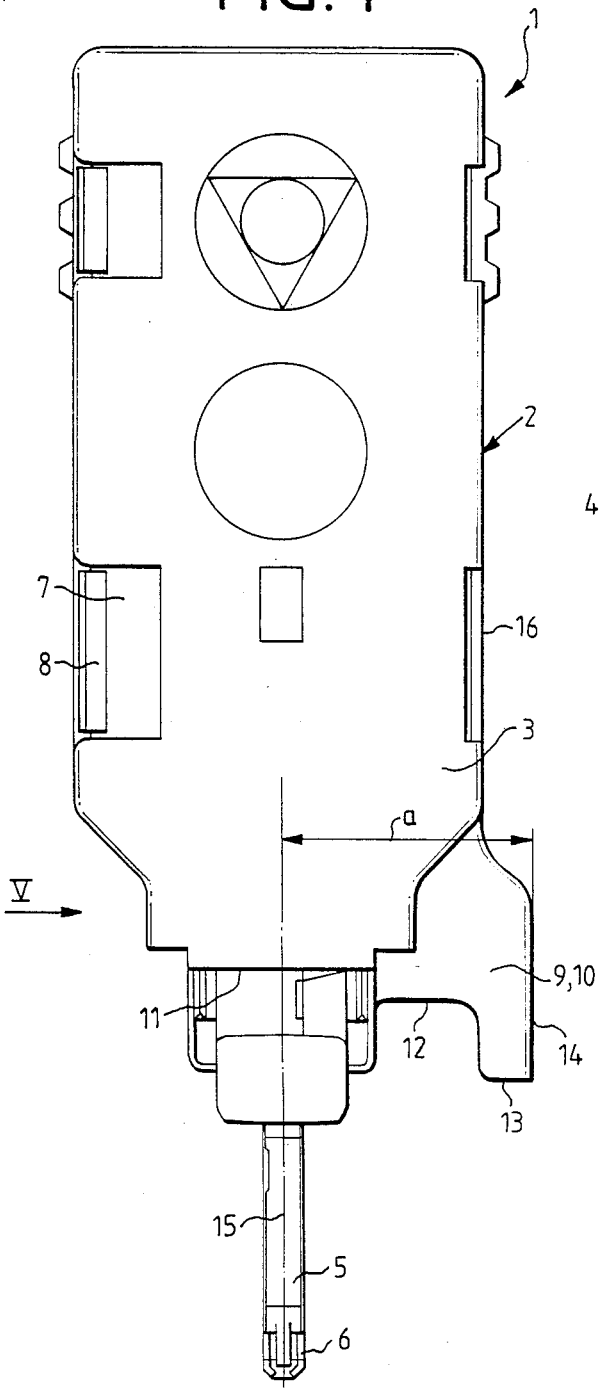
FIG. 4 is a side view of the connector in an enlarged scale.
Figure 5:
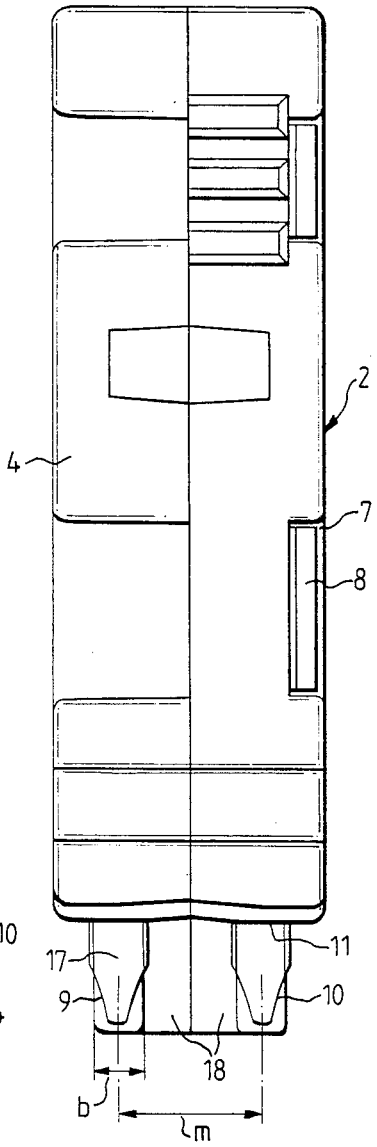
FIG. 5 is a side view of the narrow side of the connector view in the direction of arrow IV in FIG. 4, with the connector tongue removed.

On the narrow side of the housing 2 of the connector 1, a hook-type projection 9, 10 is formed on each of the two half shells 3, 4. As the half shells 3, 4 of the housing 2 of the connector are formed of molded plastic, the two projections 9, 10 are simply molded-on when manufacturing the two half shells 3, 4. The projections 9, 10 extend, as is shown in particular in FIG. 4, past the lower edge 11 of the housing 2 of the connector 1, and comprise an internal lower edge 12 and an external lower edge 13 projecting by a certain amount over the internal lower edge 12 and forming, thus, the hook-type projection 9, 10. The outside edge 14 of the projection 9, 10 protrudes from the longitudinal center axis 15 of the connector 1 by a dimension A being slightly larger than half the width B of the bank body 21 of the disconnector bank 20. Both projections 9, 10 have crosspieces 18 directed towards each other such that the projections 9, 10 and the crosspieces 18 form a U-shaped configuration, the crosspieces 18 forming the base and the projections 9, 10 forming the legs.

Figure 2:
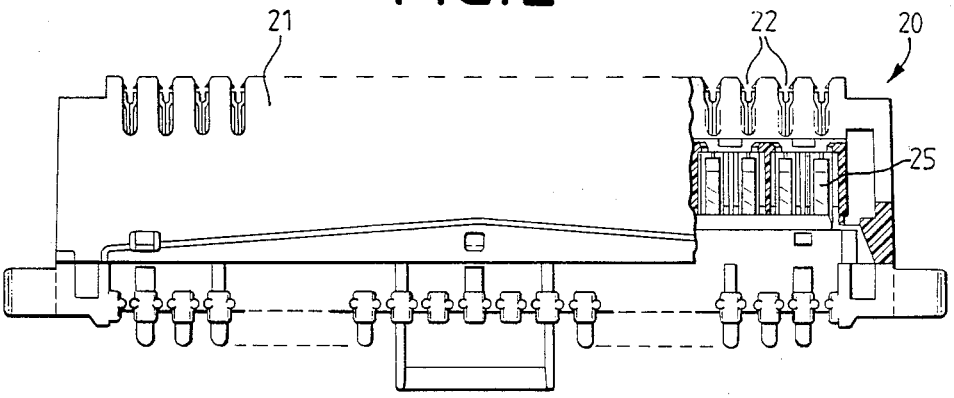
FIG. 2 is a side view of the disconnector bank in a different scale.
Figure 3:
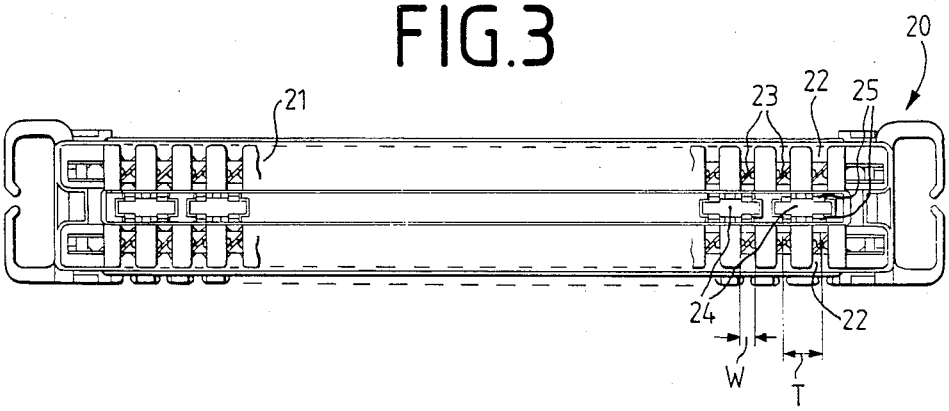
FIG. 3 is a top view of the disconnector bank according to FIG. 2.

As shown in the right-hand section of FIG. 1, the connector 1 can be inserted with its connector tongue 5 through the opening 24 of the bank body 21 up to the contact springs 25, thereby two opposed contact tracks 6 each of the connector tongue 5 coming into electrical connection with two pairs of contact springs 25, to said pairs the insulation displacement contacts 23 being respectively assigned. The projections 9, 10 of the connector 1 engage, herewith, into the assigned clamping slots 22, as shown on the right of FIG. 1.

On the side of the disconnector bank 20 shown on the left of FIG. 1, an angled bank 31 is mounted above said assigned row of clamping slots 22 as cover 30, which—by latching elements not shown in detail—is snap-fastened unreleasably in two or several of the clamping slots 22. The cover 30 is, thus, removable only by destruction. The cover 30 is composed in particular of a transparent plastic material. The cover 30 extends by its outside edge 32 by the dimension. A spaced from the longitudinal center axis 15, this dimension A being larger than the width B and being approximately equal to the dimension A, by which the outside edge 14 of the projection 9, 10 extends spaced from the longitudinal center axis 15 of the connector 1. The cover 30 serves as security device against a 180° reversed insertion of the connector 1, as is shown in FIG. 1 by the dash-dotted lines. In this case, the lower edge 13 of the hook-type projections 9, 10 will strike against the cover 30, such that the connector tongue 5 of the connection 1 is inserted into the plug opening 24, will not reach, however, the contact springs 25, such that, hereby, inserting the connector 1 in reversed condition will clearly be prevented.

While a specific embodiment of the invention has been shown and described in detail to illustrate the application of the principles of the invention, it will be understood that the invention may be embodied otherwise without departing from such principles.

What is claimed is:

1. A telecommunications plug connector arrangement, comprising: a connector, including a connector housing and a connector tongue, supported by said connector housing and joined to said connector housing at a lower edge of said connector housing, said connector tongue having contact tracks; a connector/disconnector bank having parallel rows of clamping contact slots, each clamping contact slot including a contact element, and a center row of plug openings with contact springs for receiving an assigned tongue with contact tracks, said connector/disconnector bank being symmetrical about a longitudinal central axis; a projection connected to side of said connector housing, said projection extending beyond said lower edge of said connector housing; and, a cover engaging and covering one row of said clamping contact slots, so that in the event of misinsertion of said connector, said cover and said projection cooperate thereby preventing a connector tongue from being positioned incorrectly in a corresponding plug opening.

2. A telecommunications plug connector arrangement according to claim 1, wherein said projection has a width B which is substantially equal to a gap W defined by said clamping slot.

3. A telecommunications plug connector, according to claim 2, wherein said connector housing is formed of two half shells, each half shell including a projection portion of said projection, said projection portions being spaced a distance m which is substantially equal to the pitch distance T between clamping slots of said connector/disconnector bank.

4. A telecommunications plug connector arrangement according to claim 1, wherein said cover is formed of an angled bank, unreleasably mounted o one of said rows of said clamping contact slots.

5. A telecommunications plug connector according to claim 4, wherein said angled bank is made of a transparent plastic material.

6. A telecommunications plug connector arrangement according to claim 1, wherein said connector housing includes a first and second broad side and a first and second narrow side, said projection being connected to one of said first and second narrow sides.

* * * * *